United States Patent [19]

Cohen

[11] Patent Number: 4,876,121

[45] Date of Patent: Oct. 24, 1989

[54] COSMETIC ARTIFICIAL NAILS

[76] Inventor: Allen L. Cohen, 10010 Walsham Ct., Richmond, Va. 23233

[21] Appl. No.: 252,262

[22] Filed: Sep. 30, 1988

[51] Int. Cl.[4] ..... A01N 1/00

[52] U.S. Cl. ..... 428/15; 428/16; 428/30; 428/195; 432/73; 424/61; 156/245; 156/246; 156/289

[58] Field of Search ..... 424/61; 132/73; 428/15, 428/16, 30, 195; 156/245, 246, 289

[56] References Cited

U.S. PATENT DOCUMENTS

| | | | |
|---|---|---|---|
| 2,816,555 | 12/1957 | Klump | 132/73 |
| 2,864,384 | 12/1958 | Walter | 132/73 |
| 3,357,772 | 12/1967 | Rowland | 428/30 |
| 3,357,773 | 12/1967 | Rowland | 428/30 |
| 3,598,685 | 8/1971 | Lee et al. | 132/73 |
| 3,643,361 | 2/1972 | Eaves | 428/30 |
| 3,683,419 | 8/1972 | Lewis | 428/30 |
| 3,691,971 | 9/1972 | Clarke | 428/30 |
| 3,736,946 | 6/1973 | Yando et al. | 132/73 |
| 3,898,357 | 8/1975 | Miller et al. | 132/73 |
| 4,552,160 | 11/1985 | Griggs | 132/73 |
| 4,554,935 | 11/1985 | Hokama | 132/73 |
| 4,627,453 | 12/1986 | Isler | 132/73 |
| 4,632,134 | 12/1986 | Reid | 132/73 |
| 4,671,305 | 6/1987 | Mann | 132/73 |
| 4,718,957 | 1/1988 | Sensenbrenner | 132/73 |
| 4,751,935 | 6/1988 | Mast et al. | 132/73 |

FOREIGN PATENT DOCUMENTS

| | | |
|---|---|---|
| 1186543 | 8/1959 | France . |
| 2534120 | 4/1984 | France . |
| 1280700 | 7/1972 | United Kingdom . |
| 2111431 | 7/1983 | United Kingdom . |

*Primary Examiner*—Ellis P. Robinson
*Assistant Examiner*—P. J. Ryan

[57] ABSTRACT

An artificial fingernail or toenail which can provide the illusion of length, movement, depth and even three-dimensionalism through the use of a moiré pattern.

41 Claims, 11 Drawing Sheets

FIG. 7a
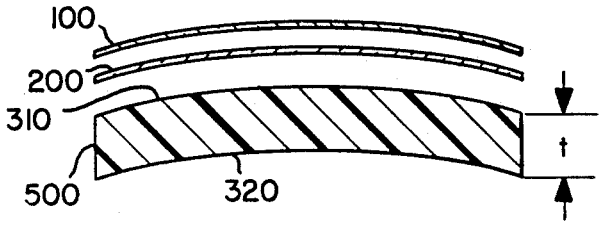
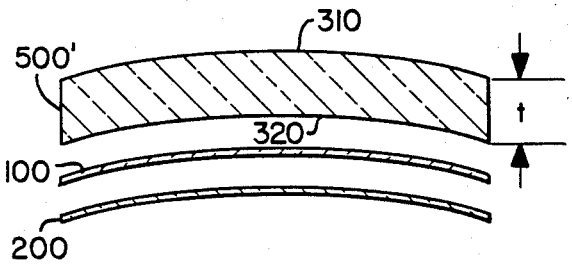
FIG. 7b
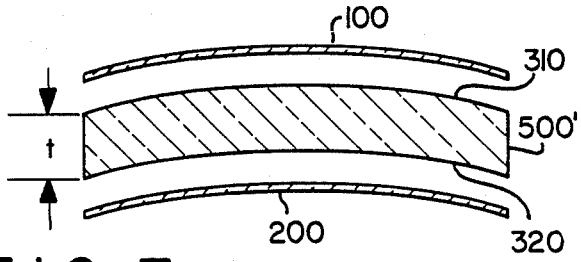
FIG. 7c
FIG. 7d
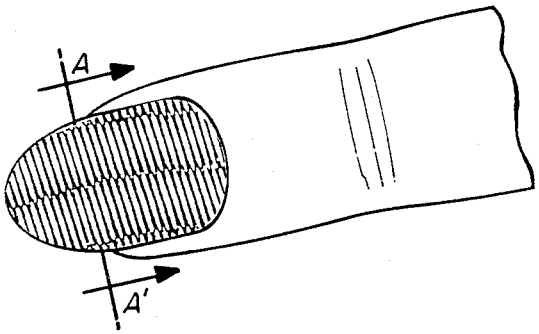

COSMETIC ARTIFICIAL NAILS

BRIEF DESCRIPTION OF THE INVENTION

Artificial fingernails and toenails possessing a moiré pattern which can provide the illusion of length, movement, depth and even three-dimensional effects. Methods of making these artificial nails are also disclosed.

BACKGROUND TO THE INVENTION

In many societies, long fingernails are considered to be cosmetically desirable. However, in order to achieve this cosmetically desirably look, one has to resort to either growing a long set of nails or, alternatively, using artificial fingernails, typically made of plastic materials. With either of these alternatives, while such long fingernails may be cosmetically attractive, they nevertheless pose a number of disadvantages to the wearer. Many people who wear false nails find them to be most uncomfortable because they sense the artificiality of the false nail which creates an insecurity in the wearing of them. The wearers also find false nails to be unnatural extensions of their regular nails consequently the false nails interfere in daily activities.

Significantly, long fingernails can be a physical handicap in a number of daily activities, such as typing, installing contact lenses, telephone dialing, playing sports, putting on sheer stockings, conventional housework, and the like. In addition, such long nails also present the problem of being prone to chipping, cracking, breaking, and other damage due to their length and their susceptibleness to being banged and bumped during a normal day's activities. When using an artificial long nail, such daily activities generally tend to, at the very least, loosen the artificial nail from the wearer's natural nail.

Still further, there are a variety of plastic false finger and toenails currently available. Those that are long in length will suffer from the above disadvantages. On the other hand, those that are somewhat shorter in length, for the "active wearer", while providing a more practical length, will of course, not provide the cosmetic look of the desirably longer length.

These artificial nails either come colorless and are meant to be covered with a nail polish or are provided with a color thereby eliminating the need for such post polishing. As with a natural nail, a design or appliqué may be applied to the colored artificial nail. Most significantly, such a design or appliqué and, clearly, a nail that is simply colored, merely provides a constant, nonchanging image to the observer of the nail regardless of the observer's position with respect to the nail. No matter which way the nail is turned, the overall effect to the observer remains constant.

On the other hand, *Walter,* U.S. 2,864,384, patented Dec. 16, 1958, describes a false fingernail that is coordinated with the exact fabric of the wearer's costume. The patentee recommends using the same fabric coated or bonded to the false fingernail as the fabric in the wearer's clothing.

THE INVENTION

The invention comprises a cosmetic false nail containing a visually viewable cosmetic pattern comprising a moiré pattern.

The invention comprises a cosmetic false nail containing a visually cosmetic pattern comprising at least two superimposed figures, the anterior most having visually existing solid or open regions, such as some sort of physically solid and open regions or visually-formed solid and open regions, spatially separated or not, which interact so as to effect a visual illusion constituting the pattern. The figures may be of the same general shape, or vastly different; and they may have the same color or have different colors.

The more varied the designs of the figures and/or the more varied the colors, the more complex will be the appearance or design of the moiré pattern.

The invention relates to false nails which contain interacting figures at least one of which has some sort of transparent, semi-transparent or open regions. One embodiment of the invention, provides for a moiré effect obtained by the interference between two or more superimposed grid pattern layers which are comprised of opaque and transparent regions and are affixed to or are part of a false fingernail; or, most desirably, on both the upper and lower surfaces of a transparent fingernail such that the grid pattern layers are separated by the thickness of the fingernail allowing for maximum parallax to take place.

The moiré effect may be used to give a shimmering or glittering illusory mental image with movement and depth by virtue of parallax due to the physical separation of the two grid pattern layers. This phantasm of movement and depth can achieve startling visual effects. Moreover, the combination of motion, depth, and parallax that is provided by the grid patterns in the grid pattern layers provides a constantly changing, aesthetically pleasing pattern to the observer. When the grid patterns are provided in different colors, the resulting moiré effect is seen as striking and unusual color patterns appearing both natural and lifelike or both unnatural and artificial. In any case, the appearance achieved is unique.

In a preferred embodiment of the present invention, the grid pattern layer positioned uppermost and closest to the observer may have its grid pattern optically formed or enhanced by the use of a patterned array of lenslets which image the grid pattern layer(s) positioned beneath it thereby providing an additional three-dimensional effect. In yet a further embodiment, these lenslets are utilized with a lower grid pattern layer comprised of mirrored concavities sufficient to effect reflected images and in particular the pattern in the upper layer. In the latter embodiment, the lenslet mirrors will have the capacity of reflecting ambient light of the fingernail wearer's environment, lending additional colorations and visual complexity to the nail. Such would add sparkle and brightness to the appearance of the nail.

The present invention encompasses an artificial nail comprising in a visually observable area thereof:

a. a first grid pattern containing opaque or partially opaque regions therein;

b. a second grid pattern superimposed over the first grid pattern and containing opaque or partially opaque regions and transparent or partially transparent regions therein;

c. a primary substrate layer having an upper surface and a lower surface; wherein the first and second grid patterns visually interact with one another to form a moiré effect.

BRIEF DESCRIPTION OF THE DRAWINGS

FIGS. 7*a*–7*c* are a series of cross-sectional drawings, taken along line A—A′ of the artificial nails of the present invention shown in FIG. 7*d*, showing different embodiments of the present invention in which the grid pattern layers are affixed at various positions on the artificial nail bed to produce the artificial nail of the present invention.

DETAILS OF THE INVENTION

Figure 1:
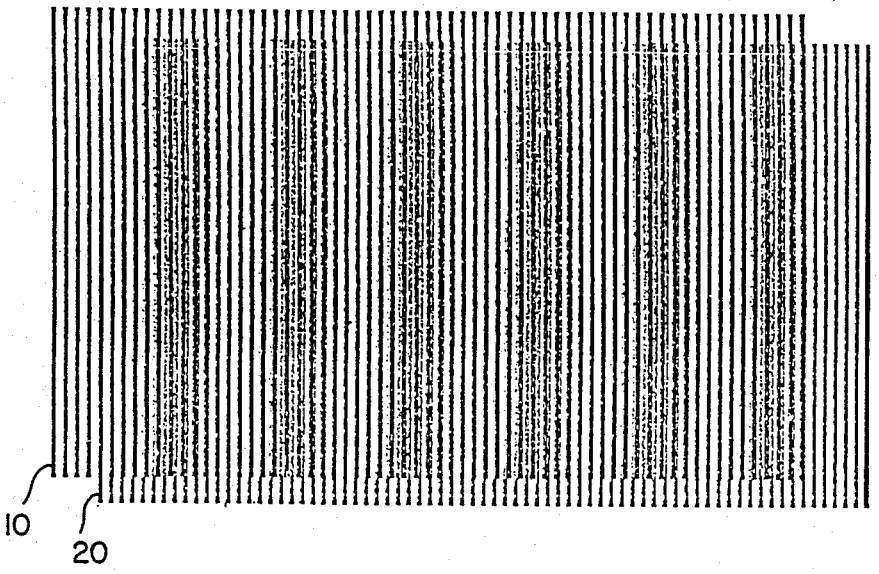
FIG. 1 shows a moiré beat pattern formed by superposing two parallel line grids of slightly different periodic spacing frequencies.

The invention relates to a new artificial finger and toenail which eliminates or substantially reduces the disadvantages and problems associated with prior art artificial nails. More particularly, the invention is directed to an artificial nail which achieves the desirable look of long nails although the artificial nail itself has an advantageously shorter, more practical length. Moreover, this illusion of length is also accompanied by an ever constantly changing, aesthetically pleasing pattern which provides a further illusion of motion, depth, color change, and/or three-dimensional effects.

Specifically, Applicant is able to accomplish the above by providing an artificial fingernail or toenail which produces a moiré effect. This moiré effect is obtained by the interference between two or more superposed grid pattern layers which are comprised of opaque and transparent regions and are affixed to an artificial nail bed; or, most desirably, on both the upper and lower surfaces of the transparent nail bed such that the grid pattern layers are separated by the thickness of the nail bed allowing for maximum parallax to take place.

The moiré effect gives rise to a shimmering illusion with movement and depth by virtue of parallax due to the physical separation of the two grid pattern layers. This illusion of movement and depth effectively mimics the appearance of long finger or toenails. Moreover, the combination of motion, depth, and parallax that is provided by the grid patterns in the grid pattern layers provides a constantly changing, aesthetically pleasing pattern to the observer. When the grid patterns are provided in different colors, the resulting moiré effect is seen as striking and unusual color patterns appearing both natural and lifelike.

The subject of moiré patterns has been addressed by *Oster, et al.*, Scientific American, pages 1–11 (May 1963). In defining the requisites of a moiré effect, they state that "[t]he only general requirement for a moiré pattern is that the interacting figures have some sort of solid and open regions. The solid regions can be lines (straight, curved or wiggly), dots or any other geometric form." As a rule, moiré patterns are produced whenever two periodic structures are overlapped. *Oster, et al.* point out that a "moiré" pattern can be regarded as the mathematical solution to the interference of two periodic functions". . .

It is offered that the moiré pattern or effect is best defined as at least two superimposed figures, at least one having some sort of transparent, semi-transparent, or open regions, spatially separated or not, which interact so as to effect a different visual appearance, constituting the pattern, representing a visual illusion of both figures even though they have not physically changed. The figures may be of the same general shape, or vastly different; and they may have the same color or have different colors. The more varied the designs of the figures and/or the more varied the colors, the more complex will be the appearance or design of the moiré pattern, though one could imagine that a highly complex pattern and/or color combination could result in sufficient cancellation of effects that the appearance of the moiré pattern could end up looking quite simple. In the definition set forth in this paragraph, the term "illusion" deserves comment. In the context of moiré patterns, the illusion is a reflection of what the mind's eye perceives from the interaction of the figures. The resulting pattern caused by such interaction appears to a viewer as having a design, shape, color, repetitiveness and/or complexity which is/are unlike the individual figures which make up the pattern. In addition, a moiré pattern does not depend per se upon the incapacity of the eye to locate space between dots. It would, in the case of dots as the figures for generating the moiré pattern, trade upon the interaction of two separate layers of dots in space to generate the pattern and the eye would depend upon the space about the dots to generate the interaction necessary for the illusion of a moiré pattern.

*Rowland*, U.S. Pat. Nos. 3,357,772 and 3,357,773, patented Dec. 12, 1967, describes the use of lenslets in plastic materials for the purpose of generating unique visual moiré patterns. *Rowland* demonstrates that a moiré pattern can be generated from a combination of open figures and lenslets. The reflective effect of the lenslet combines with the open figures to generate the moiré pattern.

In a preferred embodiment of the present invention, the grid pattern layer positioned uppermost and closest to the observer may have its grid pattern optically formed by the use of a patterned array of lenslets which image the grid pattern layer(s) positioned beneath it thereby providing an additional three-dimensional effect. In yet a further embodiment, these lenslets are utilized with a lower grid pattern layer comprised of mirrored concavities.

Accordingly, the present invention provides for an artificial fingernail or toenail for superposition on a natural fingernail or toenail comprising:

(a) a first grid pattern layer having a grid pattern containing opaque or partially opaque regions within said first pattern;

(b) a second grid pattern layer having a grid pattern containing opaque or partially opaque regions and transparent or partially transparent regions within said second pattern; and (c) a primary substrate layer having an upper surface and a lower surface; wherein the first and second grid patterns visually interact with one another to form a moiré effect.

The invention has been found to embody at least two distinct advantages over the prior art. Firstly, it provides the cosmetic look of long fingernails while, in reality, the artificial fingernails or toenails are of a practical length. Secondly, it simultaneously provides for a constantly changing, aesthetically pleasing pattern which has the elements of motion, depth, color change and even three-dimensionalism.

A grid pattern may be as simple as a set of parallel spaced lines or curves, preferably uniformly spaced apart, but may be any periodic or quasi-periodic geometric pattern of opaque and transparent regions. The necessity for at least one pattern to have transparent regions is dictated by the need to observe a posterior grid pattern through a superposed anterior grid pattern. It is, of course, well known that such superposed grid patterns will give rise to moiré patterns.

The simplest moiré pattern arises from the superposition of two sets of parallel lines. When the spacing of one set differs from that of the other, and the lines are not wide enough to fill the space, a beat is observed as shown in FIG. 1. Grid patterns 10 and 20 both consist of parallel lines, uniformly spaced apart. The spacing between the lines of grid pattern 20 is slightly less than the spacing of grid 10. The beats that are observed are the result of an apparent broadening of the lines as the two grids move out of phase. The more closely the grid spacings match, the further apart are the resulting beats. Small changes in the relative grid spacings produce large changes in the spacing of the moiré beats.

In FIG. 1, not only is the illustrated moiré pattern resolvable to the naked eye, but the individual grid patterns are similarly resolvable. However, it is clear that the moiré pattern may remain resolvable even when the individual grid patterns are so fine as to be unresolvable to the naked eye. For example, if the partially opaque colored parallel grid lines have a reflectance of 80%, and the semi-transparent open regions have a reflectance of 20%, then the resulting grid patterns will have an average reflectance of $[80+20]/2=50\%$. And if the grid lines are so closely spaced so as to be unresolvable, each grid pattern will simply appear as a uniformly colored solid region with a reflectance of 50%. The moiré pattern, however, will exhibit broad resolvable alternate colored brands of 80% and 50% reflectance respectively.

Figure 2:
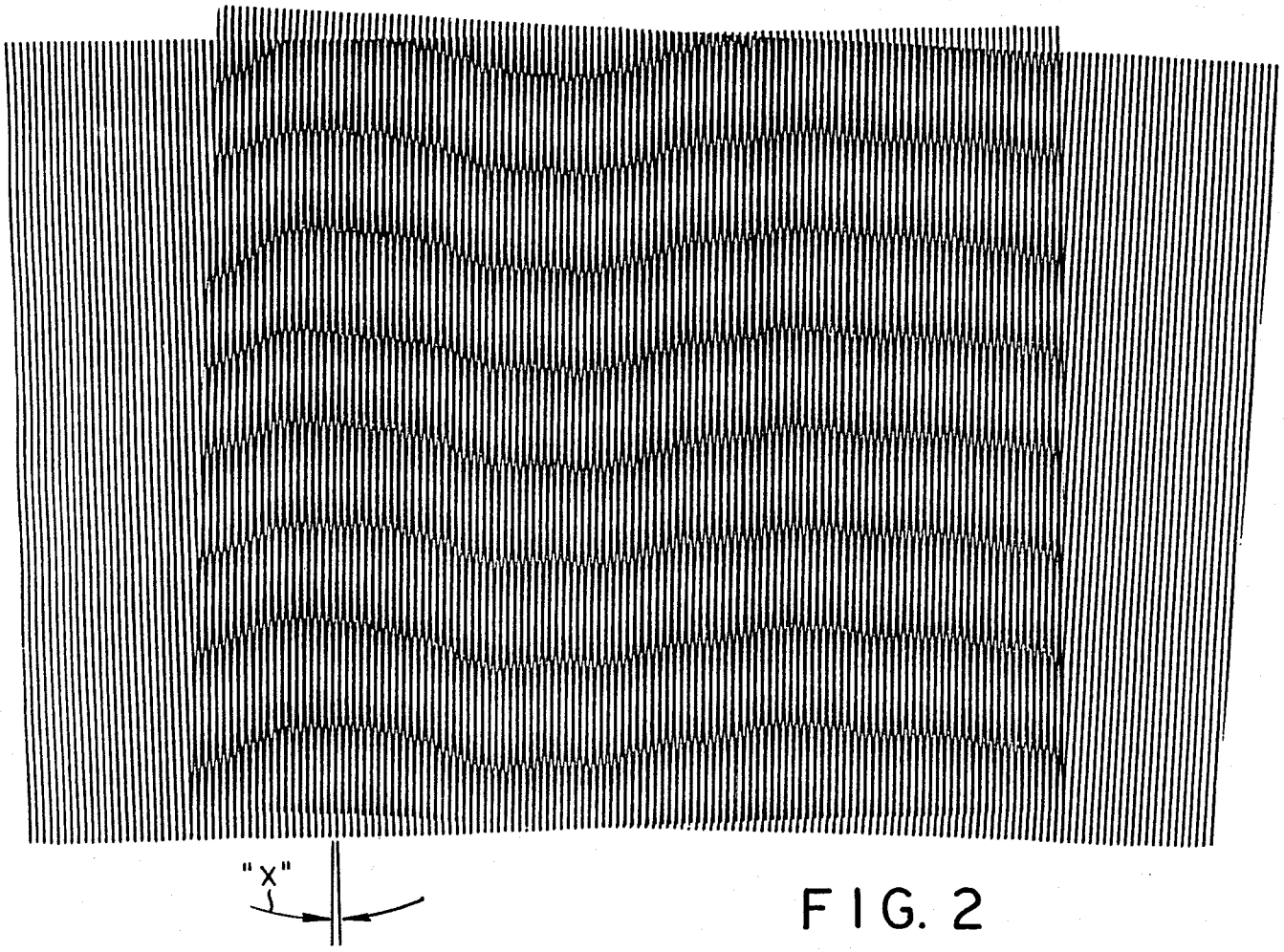
FIG. 2 shows a moiré pattern formed by superposing two identical parallel line grids with a slight angle relative to each other.
Figure 3:
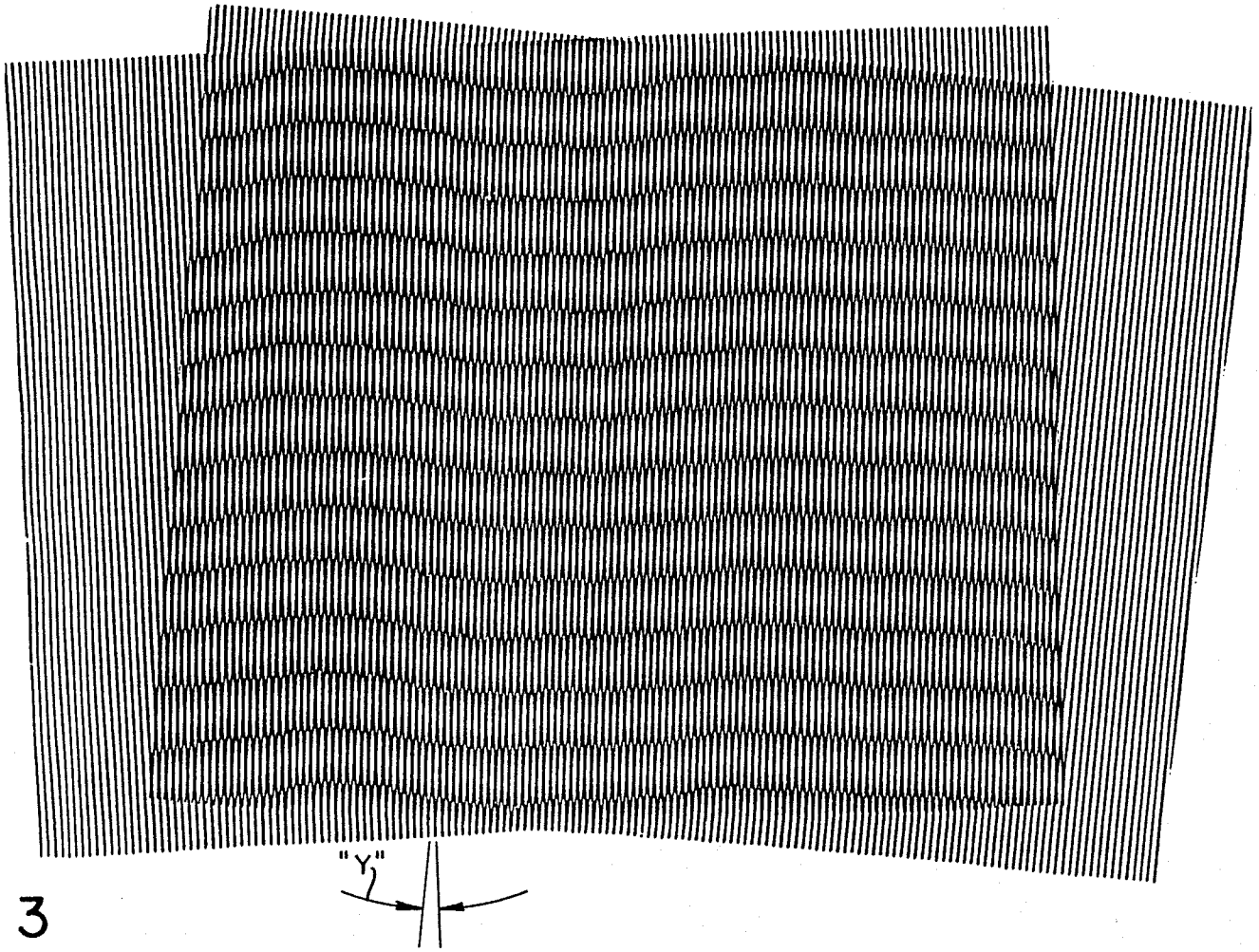
FIG. 3 is similar to FIG. 2 except that a larger angle of intersection is present resulting in a different moiré pattern.

As shown in FIG. 2, causing parallel line grids to intersect at a small angle "X", whether the spacing of each of the grids is the same or not, will also result in a set of moiré lines. In this case, the moiré lines are approximately perpendicular to the grid lines themselves. A larger angle of intersection, angle "Y", as shown in FIG. 3, will result in a more closely spaced set of moiré lines. Small changes in the angle of intersection will produce large changes in the spacing of the moiré lines or "fringes" as they are commonly called by those skilled in this art. As used herein, the "angle of intersection" of two grid patterns shall mean the angle formed by rotating one of the grid patterns relative to the other in a plane formed by the one grid pattern about its axis and where a 0 degree angle of intersection is obtained when the two grid patterns substantially coincide with and/or are parallel to one another.

The effects caused by changing the angle of intersection (relative orientation) and/or the spacings between the lines of the grid pattern (periodicity) can generally be used to create substantially any desired amount of apparent motion in the resulting moiré pattern produced. Thus, if two grids of slightly differing periodicities and/or relative orientations are slowly moved with respect to each other, a moiré pattern will be observed that moves much faster than the actual movement of the grid patterns themselves relative to one another. More motion is induced into the resulting moiré pattern by matching the periodicity and alignment of the two respective grid patterns. Conversely, less motion is obtained in the moiré pattern when the spacing of one grid is substantially dissimilar to the spacing of the other and/or the angle of intersection between the two grids is rather high. Generally, an angle of intersection in the range of from about 0 to about 45 degrees, and preferably about 0 to about 25 degrees is desirable.

It should also be noted that the spatial frequency of the grid patterns, that is, the number of lines, curves or geometric shapes per unit length, may be made so high as to render the individual opaque area of the grid patterns essentially indistinguishable from one another when vied at a distance of about 3 to about 6 feet by a person with normal 20/20 vision. Nevertheless, even though the grid patterns may not be resolvable, the moiré patterns that will be produced and the effect of movement will not be lost by the observer. Hence, line and/or geometrically shaped dot patterns with widths and spacings as small as 0.005 mm to 0.10 mm may be just as desirous as patterns with larger widths and spacings, which may also be used in the present invention. Thus, the spacing may be in the range of from about 0.0001 in (0.0025 mm) to about 0.04 in (1 mm).

Figure 4:
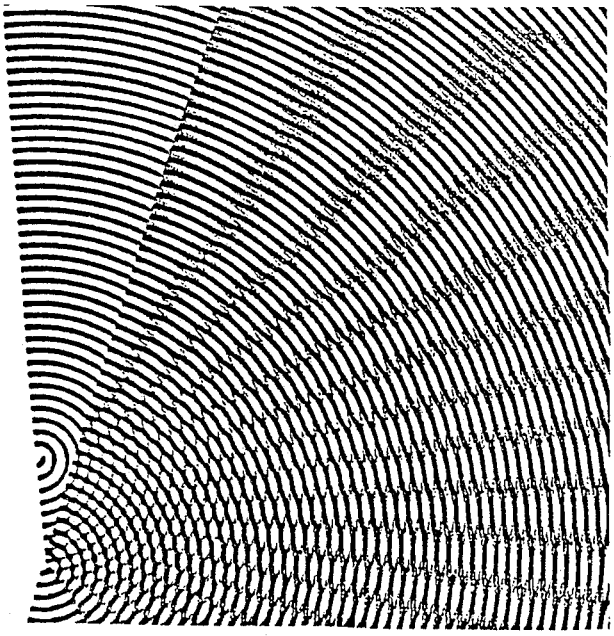
FIG. 4 shows a moiré pattern formed by superposing two circular grid patterns.

FIG. 4 sets forth a moiré pattern that is obtained when using grid patterns consisting of an array of concentric circles and shows the additional complexity that is produced in the moiré pattern by the circular patterns.

Figure 5A:
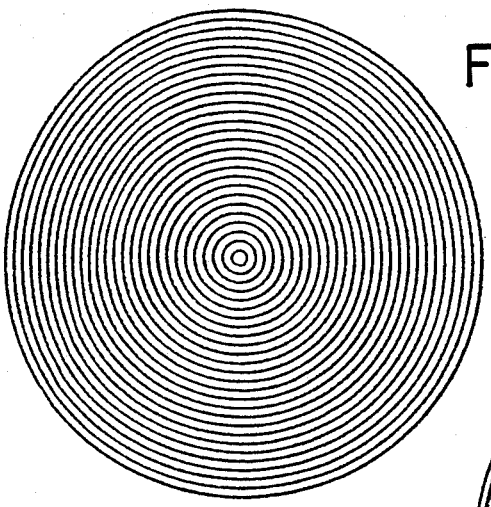
FIGS. 5*a*–5*d* are a series of drawings showing how the relative movement of one circular grid pattern against the other produces different moiré patterns.
Figure 5B:
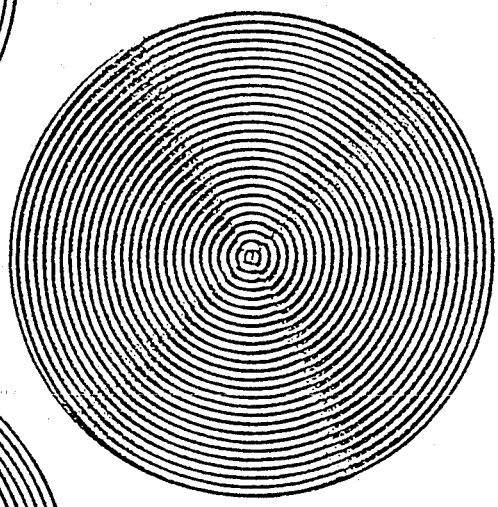
Figure 5C:
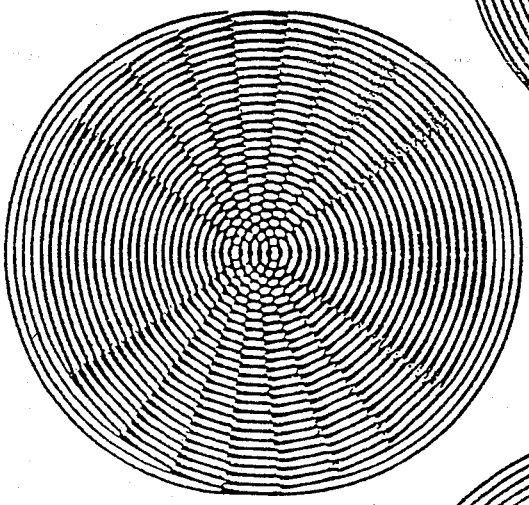
Figure 5D:
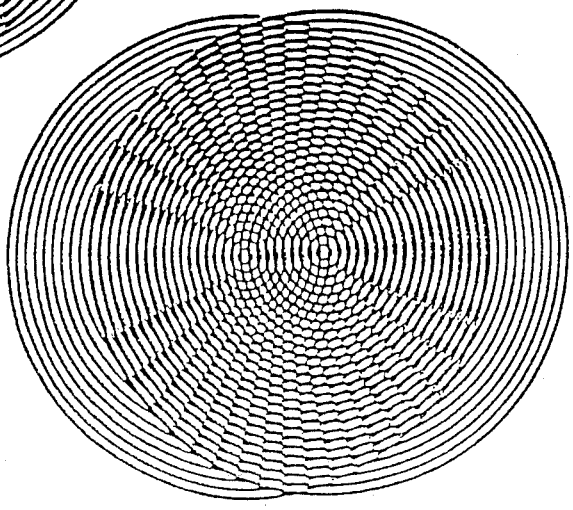

The effect of moving one circular grid pattern relative to another which is identical to the first is shown in FIGS. 5*a* through 5*d*. FIG. 5*a* shows the original position in which the first grid pattern layer is superposed on the identical second grid pattern layer. FIGS. 5*b*, 5*c*, and 5*d*, respectively, shown the upper grid pattern layer being moved to the right in progressive stages and the different moiré effects that are obtained by such relative movement. As will be discussed more fully hereinbelow, while the grid pattern layers of the artificial nail of the present invention will not be able to physically move relative to one another once they are affixed to the artificial nail bed, nevertheless, by virtue of the present invention, substantially similar moiré effects as that shown in FIGS. 5a–5d can still be obtained and seen by an observer. Simply stated at this time, such effects can be obtained as a result of parallax when the two grid pattern layers are separated from one another. In such an embodiment, as the angle made by an observer's eye with the artificial nail of the present invention changes, so does the moiré patterns observed and will be somewhat similar to the moiré patterns obtained when actually moving one grid relative to the other as seen in FIG. 5. The relative parallax is increased by using patterns with smaller grid spacings.

Figure 6:
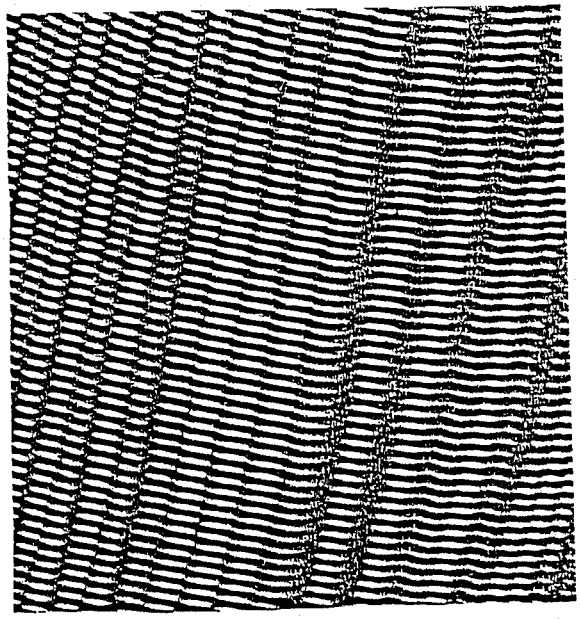
FIG. 6 shows a moiré pattern having a very natural and realistic appearance formed by circles and parallel lines (see FIG. 11*d*).

FIG. 6 shows a moiré pattern having a particularly natural looking appearance. This pattern was formed by circles and parallel lines. The use of grid patterns having quasi-random patterns produce complex looking moiré effects that desirably look natural and lifelike. Indeed, one of the objectives of the present invention is to produce an artificial nail having a natural appearing moiré pattern in combination with a shimmering movement effect introduced by parallax.

Although not shown in the Figures, color effects may also be obtained in the moiré pattern. Thus, if the patterns are comprised of, for example, opaque blue inks, there will be visually apparent areas of red-brown hues in the resulting moiré patterns. Other color effects can be produced by utilizing one or more colors in each grid pattern which may be the same or different than the one or more colors that may be utilized in the second grid pattern. The resulting color phenomena are based on the principle of complementary colors and retinal bleaching. More particularly, when regions of sharply contrasting colors are observed, small eye movements lead to the appearance of reverse patterns and complementary colors which are seen in the moiré patterns.

Figure 13A:
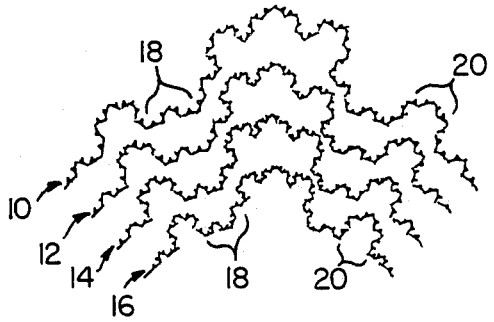
FIGS. 13*a*–13*c* show various grid pattern embodiments.

The grid patterns that produce the moiré effects may be simple or complex. A simple pattern may simply comprise a series of parallel straight lines which may or may not be uniformly spaced apart from one another. Alternatively, a series of parallel curves or, as noted above, a series of concentric circles may also be utilized as the grid pattern. A more complex grid pattern may comprise a pattern based on fractal geometry, such as the Koch snowflake curve depicted in FIG. 13a. Such designs have a basic regularity or repetitiveness in its overall general appearance, which is desirable in order to obtain a moiré effect, but yet also display a quasi-randomness in its detailed appearance which is preferred in order to obtain a more natural looking moiré effect. Thus, considering the general overall appearance of the pattern shown in FIG. 13a, lines 10, 12, 14 and 16 may be considered as a series of uniformly spaced, parallel curves each of which is substantially identical to the other. On a more detailed inspection, however, each curve consists of a series of quasi-random, fractal geometric shapes where, for example, section 18 of curve 10 is different than section 20 of that same curve. Yet, even these fractal geometric shapes are reproduced substantially similar in each of the respective curves. In particular, section 18 of curve 10 is substantially similar to section 18' of curve 16. So too, section 20 of curve 10 is substantially similar to section 20' of curve 16.

Figure 13B:
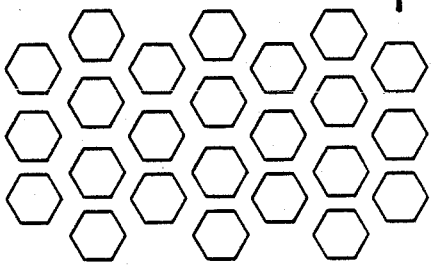
Figure 13C:
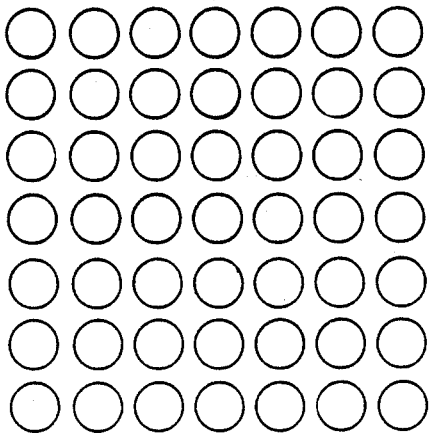

Such complex grid patterns as the ones using such fractal geometry are not all required in the present invention. A simple array of hexagonal shapes, such as the one shown in FIG. 13b may also be used, either as one or both of the at least two grid pattern layers that are required to be used in the artificial fingernails or toenails of the present invention. Similarly, the array of circular shapes or dots, as shown in FIG. 13c, may also be utilized. Indeed, any geometric shape, whether regular or irregular, may be used to form the array in order to form the grid pattern provided that the array is in some kind of uniform, periodic pattern such that when one array is placed over another grid pattern, a moiré effect is obtained. Indeed, the ultimate test as to whether a particular grid pattern applicable is if it is capable of visually interacting with another grid pattern to form a moiré effect.

As mentioned earlier, the grid patterns that interact with one another to form the moiré effect may be identical, similar, or totally different from one another and, moreover, may have the same or different colors.

It is noted that there is no criticality in the present invention with respect to the particular grid pattern design that is used in order to form the moiré effect. Any design that is capable of such a moiré effect is applicable. One skilled in the art of moiré effects can easily select grid pattern designs which will interact with one another such that a moiré effect will be obtained.

The artificial fingernails and/or toenails of the present invention are formed by utilizing a combination of an artificial nail bed (a primary substrate) and at least two or more grid pattern layers having grid patterns of the types described above which visually interact with one another to create a moiré effect. As used herein, the phrase "grid pattern layer" is meant to include an actual layer comprising a secondary substrate upon which a grid pattern, such as the ones discussed above, is formed. Alternatively, also included within the definition of "grid pattern layer", as used herein, is the grid pattern per se which is formed directly on the primary substrate.

More specifically, reference is made to FIGS. *7a–7c* which are cross-sectional views taken along line A—A' of the artificial fingernail of FIG. *7d* which shows a typical moiré effect. In other words, each of the embodiments shown in FIGS. *7a* through *7c*, respectively, is capable of producing the artificial fingernail shown in FIG. *7d* having the depicted moiré effect. It is to be understood that the moiré effect shown in FIG. *7d* is only examplary. In FIGS. *7a–7c*, the same elements are identified by the same reference numeral.

The artificial nail bed 500 or primary substrate as it will also be referred to herein, has a thickness "t" and an upper surface 310 and a lower surface 320. When in use, the upper surface 310 of the artificial nail bed faces away from the natural nail and the lower surface 320 faces the natural nail. Preferably, the artificial nail bed is in a shape which conforms to a natural nail as shown in the drawings of FIG. 7. The nail bed may have a thickness "t" which is conventional and practical for such an application. Typically, the thickness of the nail bed will be in the range of from about 0.05 mm to about 1.5 mm and preferably about 0.15 mm to about 0.8 mm.

The composition of the nail bed may comprise any material which is conventional in the art as there is no criticality in the present invention with respect to its composition. Generally, the nail bed should possess the characteristics of having sufficient rigidity to hold its shape but still have enough flexibility to withstand the typical bumping and banging caused by everyday activities. Most preferred is a material which simulates the properties of a natural nail itself.

Inasmuch as many of the preferred embodiments of the present invention, as will be discussed more fully below, require that the nail bed be transparent, it is accordingly most preferable that the composition of the nail bed be, in fact, transparent when formed. Accordingly, when transparency is desired, the nail bed is typically formed from one or more of the following polymers: polyvinylchloride, a copolymer of vinylchloride and vinyl acetate, polyvinylacetate, cellulose acetate, cellulose butyrate, Bisphenol A polycarbonate, polymethylmethacrylate, and the like, and combinations thereof. Where transparency is not required, the following polymers may also be used, alone or in combination with one another: polyethylene, polypropylene, ABS polymers, polystyrene, polyethyleneterephthalate, and the like. It is noted that the use of a polymeric material, while desired, is not required in the present invention and other suitable materials may also be utilized. The selection of a particular material suitable for use as a nail bed for an artificial nail, specifically a material made from one or a combination of polymers, is well within the conventional practice of those skilled in this art.

In the embodiment shown in FIG. *7a*, the artificial nail bed 500 need not be made from a material which is transparent. Here, grid pattern layer 200 is superposed in the upper surface 310 of nail bed 500 and grid pattern layer 100 is, in turn, superposed on grid pattern layer 200. The visual interaction of these two grid pattern layers results in the moiré effect shown in FIG. *7d*. Although only two grid pattern layers are referred to in each of the embodiments shown in FIGS. *7a–7c*, it is to be understood that yet additional grid pattern layers may also be used. Moreover, although FIGS. *7a–7c* show a relatively large spacing between each of the grid pattern layers as well as the nail bed, this has been done only for clarity.

As noted above, the grid pattern layer 100 and 200 may comprise a secondary substrate or, alternatively, the grid pattern per se. Accordingly, either or both of the grid pattern layer 100 and 200 may be comprised of a secondary substrate upon which a grid pattern is affixed, for example, by printing the pattern thereon. The one or both secondary substrates having the grid patterns affixed thereon are superposed on the artificial nail bed in the manner shown. Obviously, when using secondary substrates, in order to be able to have the grid pattern of grid pattern layer 200 visually interact with the grid pattern of grid pattern layer 100, it is necessary that at least the secondary substrate of grid pattern layer 100 be transparent. It is optional whether the secondary substrate of grid pattern layer 200 is also transparent. The secondary substrate may, if desired, be made of the same materials that comprise the primary substrate. Generally, a very thin film of this secondary substrate will be utilized, typically having a thickness in the range of from about 0.01 to about 0.05 mm. When using secondary substrates as the grid pattern layers, the artificial fingernail or toenails formed actually comprise a composite of the at least one secondary substrate and the primary substrate.

Instead of using a secondary substrate, the grid pattern layer may comprise the grid pattern per se in an alternative embodiment of the present invention. Thus, the grid pattern may simply be affixed directly to the primary substrate. In FIG. *7a*, the grid pattern layer 200, consisting only of the grid pattern, may be directly affixed to upper surface 310 of primary substrate 500 by stenciling, for example, the pattern thereon. Grid pattern layer 100, also consisting of the grid pattern per se, may then in turn be stenciled and superposed on top of the grid pattern from grid pattern layer 200.

In a further embodiment of the present invention, both of the grid pattern layers may be positioned on the lower surface of the artificial nail bed. Particularly, in FIG. *7b*, grid pattern layer 100 is first superposed onto the lower surface 320 of nail bed 500 and grid pattern layer 200 is, in turn, superposed onto grid pattern layer 100. Of course, the artificial nail bed 500 must be transparent in order for the observer to see the visual interaction of the two grid patterns positioned beneath the nail bed. As is the embodiments of FIG. *7a*, the grid pattern layers may comprise a secondary substrate or merely the grid pattern per se. In either of these alternative embodiments, the resulting moiré effect can be made to be substantially similar to that shown in FIG. *7d*.

In a most preferred embodiment, as shown in FIG. *7c*, at least one grid pattern layer is positioned on the upper surface 310 of artificial nail bed 500 and the at least one other grid pattern layer is positioned on the bottom surface 320. In this manner, the at least two grid pattern layers are separated by the thickness "t" of the nail bed. This separation allows for and provides for parallax between the respective upper and lower positioned grid pattern layers resulting in a greatly enhanced moving or shimmering effect caused by the interference between the two or more superposed grid patterns. In this embodiment too, the grid pattern layers may comprise a secondary substrate or the grid pattern per se.

The embodiment of FIG. *7c* may also be provided with grid pattern layers which provide for the moiré effect shown in FIG. *7d*. However, with this embodiment, the shimmering and movement of the moiré pattern is noticeably increased. The thickness "t" of the primary substrate 500 as well as the periodicity of the grid patterns themselves, have an effect upon the resulting shimmering and movement of the moiré pattern that is produced. For grid patterns with relatively wide lines and large spacings, a larger thickness "t" between the grid pattern layers is desirable. For relatively smaller grid spacing, only a small thickness "t" is generally needed in order to obtain the optimum shimmering effect in the moiré pattern. In general, a desirable shimmering effect is obtained when the thickness "t" of the nail bed is at least as large as the grid pattern periodicity.

Figure 8:
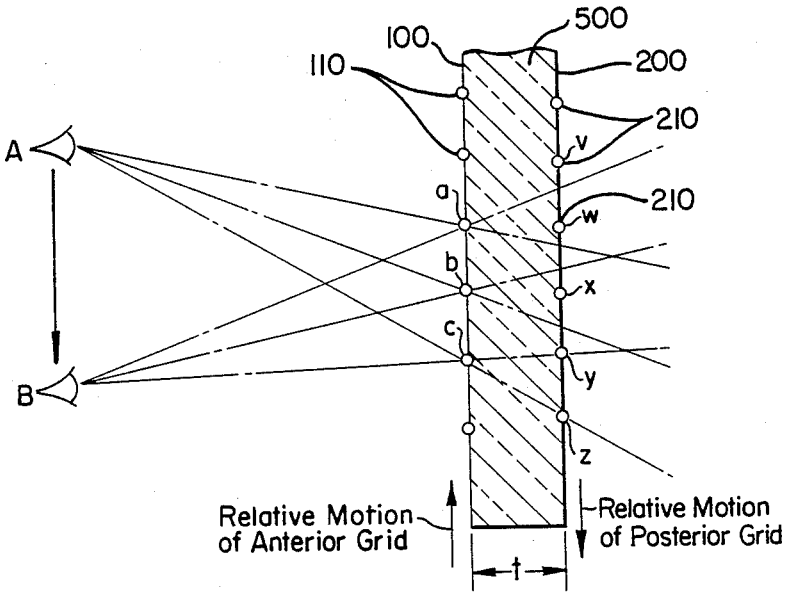
FIG. 8 shows a cross-sectional view of a moving eye observing one embodiment of the artificial finger nail of the present invention.
Figure 9A:
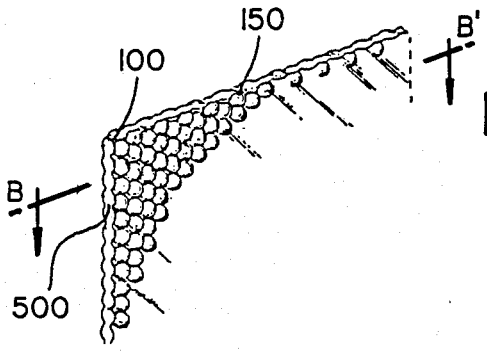
FIGS. 9*a*–9*c* show various alternative embodiments of the present invention in which the anterior grid pattern layer is comprised of optical lenslets.
Figure 9C:
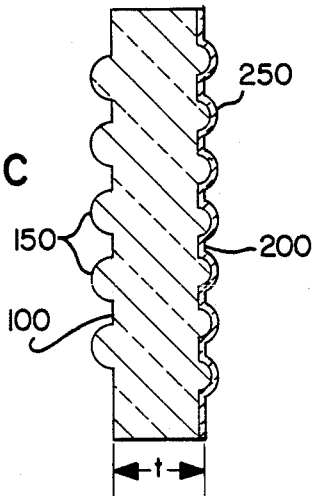
Figure 9B:
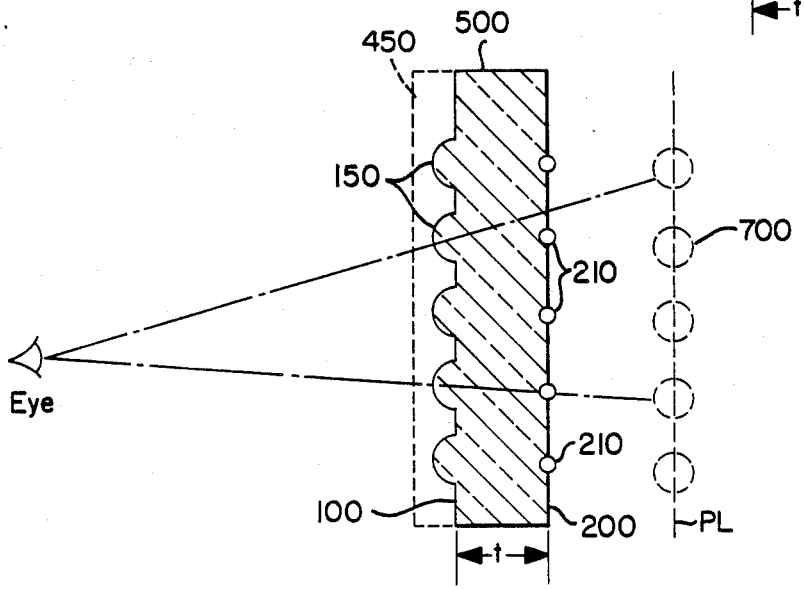

The effect of parallax may be better understood be reference to FIG. 8. There, nail bed 500 is shown having grid pattern layer 100 superposed on the upper surface of the nail bed and grid pattern layer 200 superposed on the lower surface of the nail bed. Grid pattern layer 100 has grid pattern 110 affixed thereon and grid pattern layer 200 has grid pattern 210 affixed thereon, respectively. The relative phase between the two grid patterns will depend upon the angle of view by the observer. Thus, as an observer moves with respect to the false nail, parallax will change the relative phase between the two grid patterns resulting in a change or apparent movement of the moiré pattern. This is seen in FIG. 8 where an observer at point "A" will see the interaction of points "a", "b" and "c" of grid pattern 100 with the points "w", "x", "y" and "z" of grid pattern 210. As the eye of the observer moves from position "A" to position "B", however, the observer now sees the interaction of points "a", "b" and "c" of grid pattern 110 with points "v", "w", "x" and "y" of grid pattern 210 which gives the appearance of grid pattern 110 moving in a direction which is opposite to the motion of the eye with respect to grid pattern 210. It is this motion or shimmering effect which is desirably obtained as a result of parallax which is somewhat similar to the movement of the moiré patterns obtained when actually moving one grid relative to the other as seen in, for example, FIG. 5 which has been discussed above.

Turning back to the embodiments shown in FIGS. *7a–7c*, although not shown, each of these embodiments also includes a means for securing the false nail to the natural nail of the wearer. More specifically, in the embodiment of FIG. *7a*, the securing means would be superposed on at least a portion of the lower surface 320 of the primary substrate 500. In the embodiments of FIGS. *7b* and *7c*, respectively, the securing means would be superposed on at least a portion of grid pattern layer 320.

The means for securing the artificial nail of the present invention to the natural nail may comprise any of the conventional means well known to those skilled in the art. For example, the securing means may comprise a pressure sensitive adhesive layer which is covered by a removable release paper. Alternatively, the securing means may comprise a liquid adhesive which is applied to the artificial nail just before it is ready to be positioned on the natural nail. Generally, any adhesive that is capable of securely maintaining the artificial nail attached to the natural nail but which will allow the user to remove the artificial nail when desired without undue difficulty would be desirable as an adhesive herein. Typical adhesives include rubber based adhesives as discussed in, for example, U.S. Pat. Nos. 3,289,478 and 3,787,531; acrylic based adhesives as described in U.S. Pat. Nos. 3,008,850 and 3,924,044. Other adhesive systems such as those discussed in U.S. Pat. Nos. 4,615,348 and 4,745,934 are also applicable.

In yet a further preferred embodiment of the present invention, the grid pattern on the anterior grid pattern layer, i.e., the grid pattern layer positioned closest to the observer and furthest away from the natural nail, may be optically formed by the use of a patterned array of lenslets which image the grid pattern of a grid pattern layer superposed beneath this lenslet layer. This embodiment provides for the additional characteristics of both depth and three-dimensionalism to the resulting moiré pattern produced.

The use of lenslet arrays is well known and the underlying principles of these lenslets are discussed in, for example, U.S. Pat. No. 3,503,315 which is incorporated herein by reference as if set out in full.

Referring to FIG. *9a*, a grid pattern layer 100, greatly magnified, having individual lenslets 150 is shown. Each lenslet is substantially dome-shaped having a convex portion and a concave portion. In use, the observer will always see the convex portion of the lenslets regardless of whether the grid pattern layers is superposed on the upper surface of the nail bed, as shown in FIG. *9a*, or superposed on the lower surface of the nail bed (not shown).

FIG. *9b* shows a cross-sectional view of the artificial nail of FIG. *9a* taken along line B—B′ showing the lenslet array on grid pattern layer 100, grid pattern layer 200 with grid pattern 210 and individual lenslets 150. In this embodiment, nail bed 500 must, of course, be transparent in order to allow for the visual interaction and imaging of grid pattern 210 with the lenslets of grid pattern layer 100. As is seen from FIG. *9b*, grid pattern 200 will phase in and out of alignment with the anterior lenslets resulting in the optical images taking on a characteristic moiré pattern. However, this moiré pattern will exhibit the added characteristic of depth. The moiré pattern may appear to stand out in front of the lenslet array, or may appear to be located behind the lenslet array, as shown in FIG. *9b* as image 700, depending upon the specific configurations of lenslets, their focal length, and the grid spacings.

The lenslet array may be identical, similar or different than grid pattern 210. Generally, each of the lenslets has a focal length which is on the same order of magnitude as the distance "t" separating grid pattern layer 100 from grid pattern layer 200. Typically, the focal length is less than 10 times but greater than 0.10 times the distance "t" separating the two respective grid pattern layers. Further, the lenslets will generally have a radius of curvature in the range of from about 0.02 to about 0.5 mm. The radius R effects the position in space of the image plane and thereby the apparent depth of the moiré illusion. This is illustrated by the following:

$$=\eta R/(\eta-\eta')$$

where $\eta'$=refract index of air (or protective coating;
f=focal length;
$\eta$=refractive index of primary substrate;
and R=radius of lenslet.

Optionally, the grid pattern layer 100 containing the lenslet array may desirably be covered with a protective coating layer 450 shown in dotted line. This protective coating may be comprised of a coating of any of the aforementioned polymer from a solvent solution of the polymer. Generally, this coating must also be transparent and be able to be tough enough so as to act as a protective barrier for the lenslets against damage caused by daily activities. The protective layer will typically have a refractive index in the range of from about 1.1 to about 1.5.

In yet another embodiment, as shown in FIG. *9c*, the posterior grid pattern may be in the form of an array of opaque concavities, preferably multicolored, as described in U.S. Pat. No. 1,918,705 which is incorporated herein by reference as if set out in full. Indeed, the posterior grid pattern 200 may actually be in the form of an array of concave mirrors 250 which is discussed in U.S. Pat. No. 3,357,772 which is also incorporated herein by reference as if set out in full. The dome-shaped mirrors have concave surfaces which all face towards the concave portions of the lenslets. The moiré effects materialize as the anterior lenslet array phases in and out of registration with the posterior mirror array. A three-dimensional moiré pattern is obtained by virtue of this embodiment.

Although the embodiments shown in FIGS. *9a–9c* all show grid pattern layers on opposite sides of the nail bed, which is, in fact, the preferred manner when utilizing the lenslet grid pattern layer, it is not required that the configuration be such. It is still possible to employ all of the embodiments shown in FIGS. *7a–7c* provided that the lenslet array layer is always the uppermost grid pattern layer.

The artificial nails of the present invention are made by first providing a primary substrate having an upper and lower surface. A first grid pattern layer is affixed to one of the surface of the primary substrate. A second grid pattern layer is then affixed on the other of the said surfaces of the primary substrate or over the said first grid pattern layer wherein the first and second grid patterns visually interact with one another to form a moiré effect.

More particularly, the primary substrate or nail bed may typically be provided by pressure and/or heat molding the polymeric materials discussed above, preferably in a form such that it conforms to the curvature of the natural fingernail or toenail. Alternatively, the nail bed may also be formed by die cutting a sheet of the polymeric material. In general, any conventional technique well known to those skilled in the art of forming the nail bed may be used in the present invention.

The grid pattern may be directly affixed to the upper and/or lower surfaces of the nail bed by any means which is capable of providing a relatively permanent manifestation of the grid pattern on the nail bed. Any technique which is conventional in the art of doing so would be applicable. In particular, the grid pattern may be obtained by printing, stenciling, drawing, painting, heat transferring inks, and the like, the pattern directly onto the nail bed by specific means well known to those skilled in the art. Alternatively, the grid pattern may first be affixed to a secondary substrate by any of these techniques and the resulting grid pattern layer containing the grid pattern is then superimposed on the primary substrate.

The secondary substrate may be affixed to the primary substrate by superposing these substrates with adhesive layers. Preferably, a composite is made by superposing these substrate layers and subjecting the composite to heat and pressure to form the artificial nail.

In connection with the embodiment pertaining to the lenslets, reference is made to the aforementioned U.S. Patents as to the methods of their manufacture. Generally, these lenslets are made by molding techniques. So too, the mirrored concavities may also be provided by molding techniques as well, all of which are well known to those skilled in the art as noted by the aforementioned patents.

EXAMPLE 1

Figure 10C:
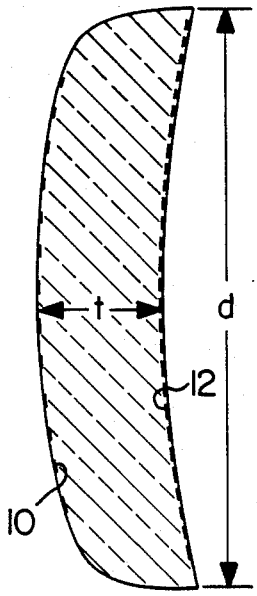
FIGS. 10*a*–10*d* show one embodiment of the present invention including each of the grid pattern layers, their positioning on the nail bed, and the resulting moiré pattern produced.
Figure 10A:
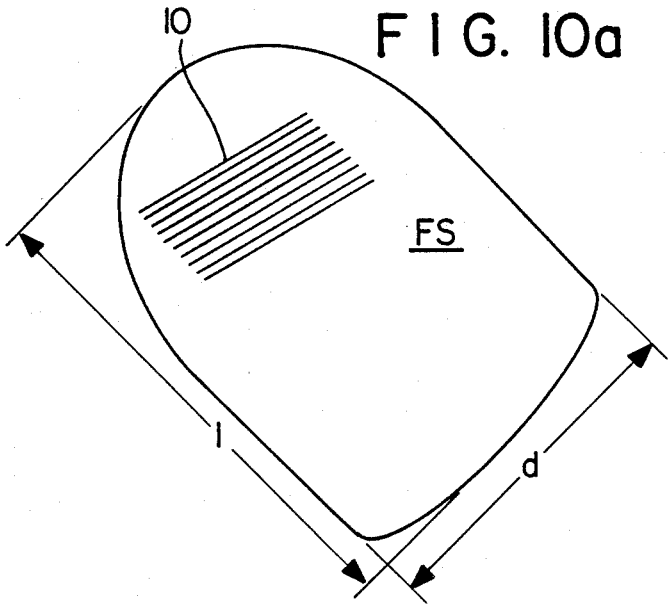

An artificial fingernail is made, as shown in FIGS. 10*a*–10*d*, having an anterior grid pattern 10 shown in FIG. 10*a* which comprises a series of about 1000 parallel light blue lines each approximately 0.005 mm wide and spaced about 0.010 mm apart spanning the nail length "l" of 15 mm. Posterior grid pattern 12 shown in FIG. 10*b* comprises about 1500 parallel dark blue lines each approximately 0.005 mm wide and spaced approximately 0.005 mm apart. The angle of intersection between the anterior and posterior grid patterns is about 10 degrees.

Figure 10B:
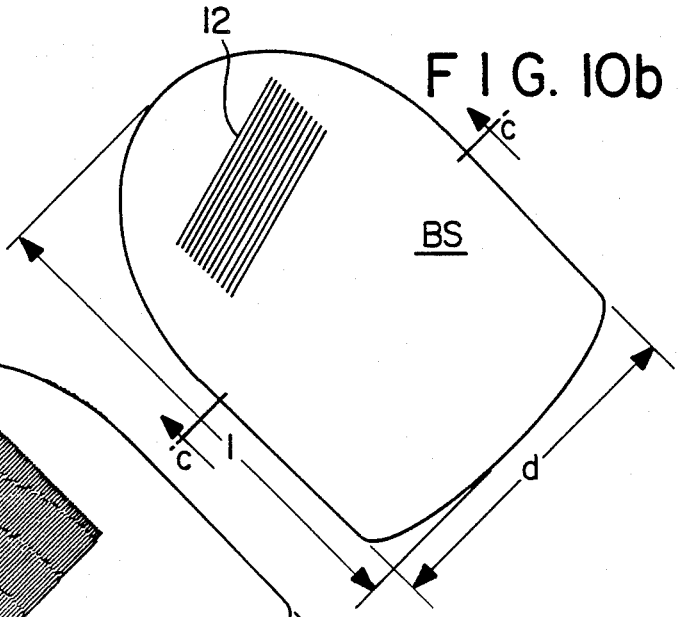
Figure 10D:
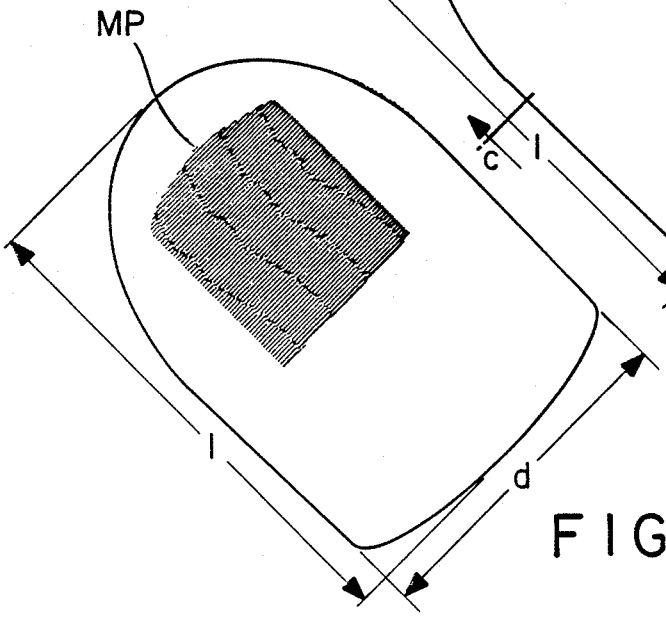

A cross-sectional view taken along line C—C' of FIG. 10*b* shows that anterior grid pattern 10 is positioned on the upper surface of the nail bed and posterior grid pattern 12 is positioned on the lower surface of the nail bed. The nail bed has a thickness "t" of 0.12 mm and a width of "d" of 12 mm. In FIG. 10*d*, the resulting moiré pattern is shown which, of course, will present a shimmering appearance to any observer as he changes his viewpoint.

EXAMPLE 2

An artificial nail is prepared as shown in FIGS. 11*a*–11*d*. Grid pattern 10 comprises a series of about 1200 parallel brown lines approximately 0.005 mm wide and spaced approximately 0.005 mm apart running the length "l" of the nail equal to 20 mm. Grid pattern 12 comprises about 2000 light green concentric circular arcs approximately 0.005 mm wide and spaced approximately 0.005 mm apart. The concentric arcs span the entire nail width "d" which is equal to 12 mm.

Figure 11C:
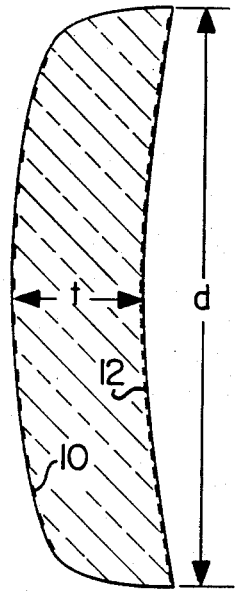
FIGS. 11*a*–11*d* show another embodiment of the present invention including each of the grid pattern layers, their positioning on the nail bed, and the resulting moiré pattern produced.
Figure 11A:
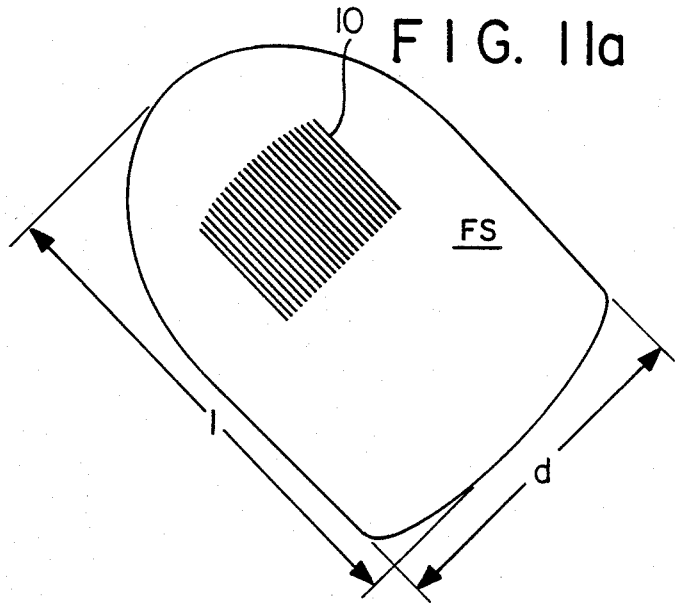
Figure 11B:
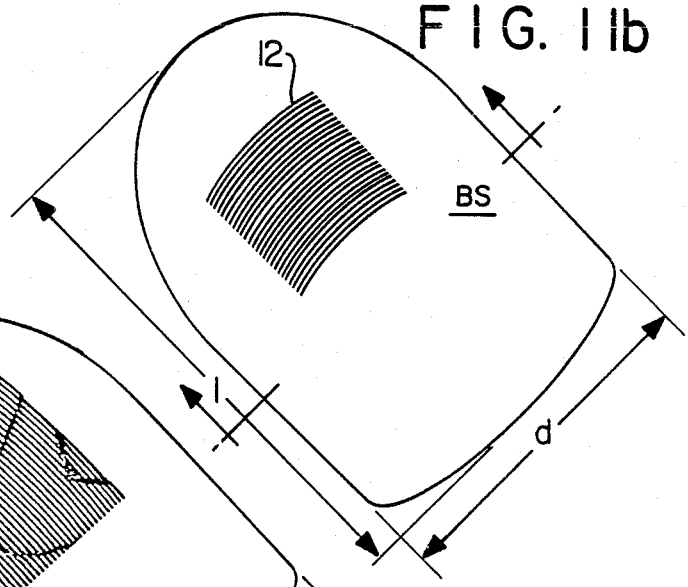
Figure 11D:
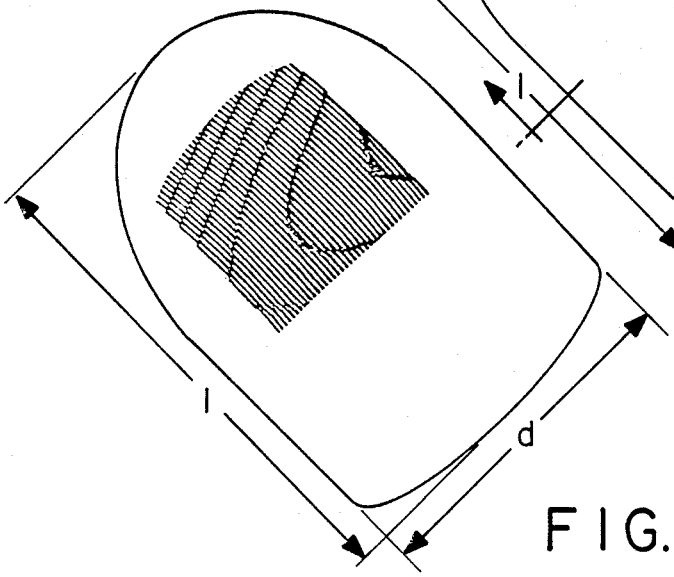

In the cross-sectional view shown in FIG. 11*c* taken along line C—C' of FIG. 11*b*, it is seen that grid pattern 12 is superposed on the upper surface of the nail bed and that grid pattern 10 is superposed on grid pattern 12. The nail bed has a thickness of 0.08 mm, a width of 12 mm. The resulting moiré pattern is shown in FIG. 11*d*.

EXAMPLE 3

An artificial fingernail is made utilizing a lenslet array as the anterior grid pattern layer as shown in FIGS. 12*a*–12*d*. Anterior grid pattern 10 comprises a series of about 500 parallel dome-shaped lenslets. Each lenslet has a radius of curvature (R) of about 0.01 mm, and is covered with a transparent protective material having a refractive index $\eta'$ equal to 1.33. The nail bed has a refractive index of $\eta$ equal to 1.44. This combination gives each lenslet a focal length $f=\eta R/(\eta-\eta')=0.13$ mm.

Figure 12C:
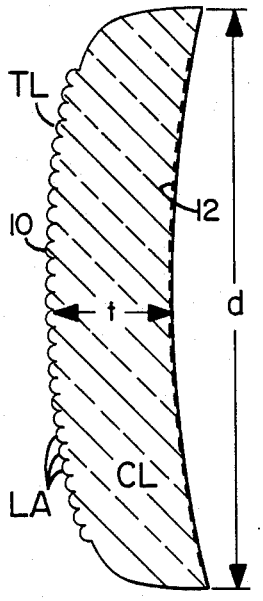
FIGS. 12*a*–12*d* show yet another embodiment of the present invention including each of the grid pattern layers, their positioning on the nail bed, and the resulting moiré pattern produced.
Figure 12A:
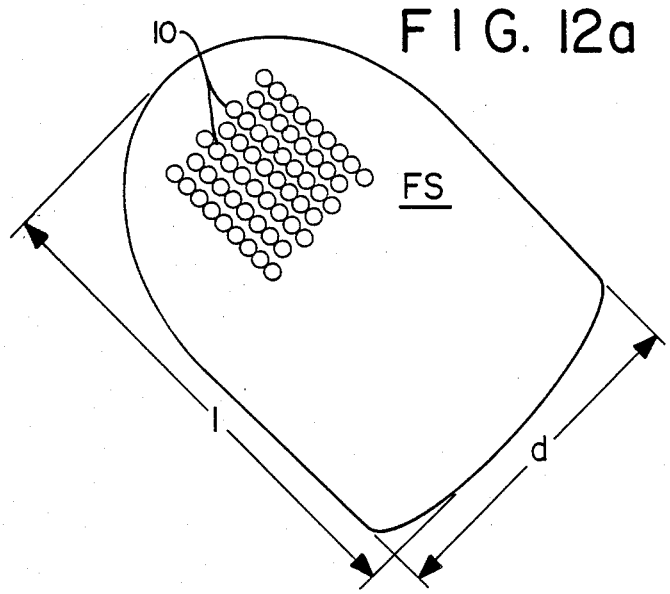
Figure 12B:
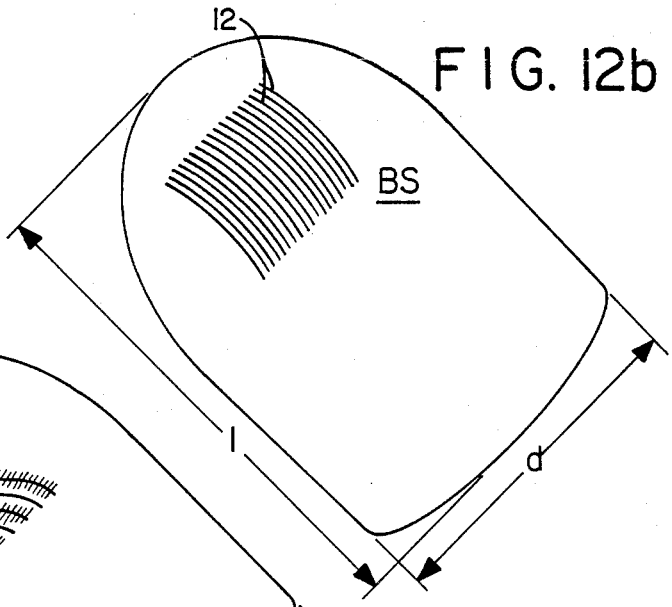

The posterior grid pattern, as shown in FIG. 12*b*, comprises about 1000 light green circular arcs approximately 0.005 mm wide each of which is spaced approximately 0.005 mm apart. These concentric circular arcs cover the entire lower surface of the nail bed which is 0.13 mm thick and 10 mm wide.

Figure 12D:
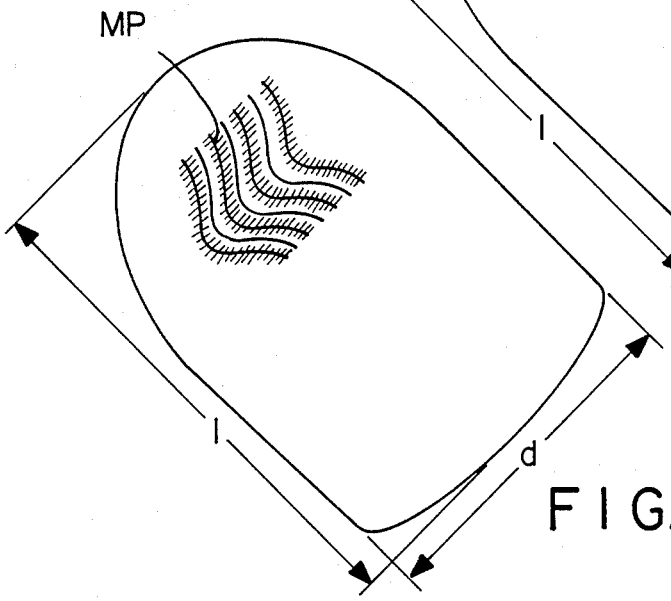

The resulting moiré pattern is shown in FIG. 12*d*. This moiré will present a shimmering colored appearance to any observer as such observer changes his viewpoint. Moreover, there will also be an illusion of depth.

What is claimed is:

1. An artificial fingernail or toenail wherein such is useful for superposition on a natural fingernail or toenail and comprises:

(a) a primary substrate layer, forming the nail bed, that is transparent or partially transparent and has an upper surface and a lower surface, said surfaces separated by the physical thickness of the substrate material itself, said thickness functioning to allow for a parallax effect;

(b) a first grid pattern layer having a first grid pattern therein containing opaque or partially opaque regions within said first pattern, said first grid pattern layer superposed on the lower surface of the primary substrate layer; and (c) a second grid pattern layer having a second grid pattern therein containing transparent or partially transparent regions within said second pattern, said second grid pattern layer superposed on the upper surface of the primary substrate layer.

2. The artificial fingernail or toenail of claim 1 wherein the second grid pattern comprises opaque or partially opaque regions.

3. The artificial fingernail or toenail of claim 1 further comprising a means for securing the artificial fingernail or toenail to the natural nail.

4. The artificial fingernail or toenail of claim 3 wherein the securing means is comprised of a pressure sensitive adhesive layer.

5. The artificial fingernail or toenail of claim 3 wherein the securing means is comprised of a liquid adhesive.

6. The artificial fingernail or toenail of claim 3 wherein the means for securing the artificial nail to the natural nail is superposed on at least a portion of the first grid pattern layer.

7. The artificial fingernail or toenail of claim 2 wherein the primary substrate substantially conforms to the curvature of the natural fingernail or toenail.

8. The artificial fingernail or toenail of claim 2 wherein the first and/or second grid pattern layer is comprised of a secondary transparent substrate upon which the grid pattern is formed.

9. The artificial fingernail or toenail of claim 2 wherein the first and/or second grid pattern layer is comprised of the grid pattern.

10. The artificial fingernail or toenail of claim 2 wherein the first and/or second grid pattern comprises a series of substantially parallel lines, curves, geometric shapes or a combination thereof.

11. The artificial fingernail or toenail of claim 10 wherein the first and/or second grid pattern comprises a series of concentric circles.

12. The artificial fingernail or toenail of claim 10 wherein the lines, curves or geometric shapes are comprised of one or more colors.

13. The artificial fingernail or toenail of claim 12 wherein the one or more colors in the first grid pattern are different than the one or more colors in the second grid pattern.

14. The artificial fingernail or toenail of claim 10 wherein the parallel lines, curves or geometric shapes are substantially uniformly spaced.

15. The artificial fingernail or toenail of claim 14 wherein the lines, curves or geometric shapes are spaced apart about 0.001 to 1.0 mm.

16. The artificial fingernail or toenail of claim 15 wherein the spacing is about 0.005 to about 0.1 mm.

17. The artificial fingernail or toenail of claim 1 wherein the second grid pattern layer is comprised of transparent lenslets.

18. The artificial fingernail or toenail of claim 17 wherein the lenslets are arranged in a pattern selected from a series of substantially parallel lines, curves, geometric shapes or a combination thereof.

19. The artificial fingernail or toenail of claim 18 wherein the patterned array is identical, or similar to that of the first grid pattern layer.

20. The artificial fingernail or toenail of claim 17 wherein each lenslet is substantially dome-shaped having a convex portion facing away from the primary substrate and a concave portion facing towards the primary substrate.

21. The artificial fingernail or toenail of claim 17 wherein the lenslets may each have a different focal length, but each specific focal length is less than 10 times but greater than 1/10 the distance between the first grid pattern layer and the second grid pattern layer.

22. The artificial fingernail or toenail of claim 21 wherein the focal length of the lenslets are all identical or at least within 10% of each other.

23. The artificial fingernail or toenail of claim 17 wherein the lenslets have a radius of curvature in the range of from about 0.02 to 0.5 mm.

24. The artificial fingernail or toenail of claim 17 wherein a protective layer is superposed on the transparent lenslets grid pattern layer.

25. The artificial fingernail or toenail of claim 24 wherein the protective layer has a refractive index in the range of from about 1.1 to 1.5 and the primary substrate has a refractive index in the range of from about 1.3 to 1.6 to cause each lenslet to have a focal length in the range of from about 0.05 to 1.5 mm.

26. The artificial fingernail or toenail of claim 17 wherein the second grid pattern layer is comprised of a patterned array of dome-shaped mirrors having concave surfaces facing towards the concave portions of the lenslets.

27. The artificial fingernail or toenail of claim 2 wherein the angle of intersection between the first grid pattern and the second grid pattern is in the range of from about 0 to about 45 degrees.

28. The artificial fingernail or toenail of claim 27, wherein the angle of intersection is in the range of from about 0 to about 25 degrees.

29. A method of making an artificial fingernail or toenail for superposition on a natural fingernail or toenail comprising:

(a) providing a transparent or partially transparent primary substrate of thickness sufficient to allow for a parallax effect, said thickness bounded by an upper and lower surface;

(b) affixing a first grid pattern layer having a grid pattern containing opaque regions or partially opaque regions within said first pattern on the lower surface of the primary substrate; and (c) affixing a second grid pattern layer having a grid pattern containing transparent or partially transparent regions within said second pattern on the upper surface of the primary substrate, wherein the first and second grid patterns visually intersect with one another to form a moiré effect.

30. The method of making an artificial fingernail or toenail of claim 29, wherein the primary substrate is provided by molding a polymeric material.

31. The method of making an artificial fingernail or toenail of claim 36 wherein the primary substrate is molded such that it conforms to the curvature of the natural fingernail or toenail.

32. The method of making an artificial fingernail or toenail of claim 31 wherein the primary substrate is provided by die cutting a sheet of the polymeric material.

33. The method of making an artificial fingernail or toenail of claim 32 wherein the primary substrate is die cut from the sheet of polymeric material is subjected to heat and pressure so as to provide the primary substrate with a curvature similar to the natural fingernail or toenail.

34. The method of making an artificial fingernail or toenail of claim 29 further comprising affixing a means for securing the artificial fingernail or toenail to the natural nail.

35. The method of making an artificial fingernail or toenail of claim 29 wherein the grid pattern comprises a series of substantially parallel lines, curves, geometric shapes or a combination thereof.

36. The method of making an artificial fingernail or toenail of claim 35 wherein the grid pattern comprises a series of concentric circles.

37. The method of making an artificial fingernail or toenail of claim 36 wherein the lines, curves or geometric shapes are opaque.

38. The method of making an artificial fingernail or toenail of claim 37 wherein the lines, curves or geometric shapes are comprised of one or more colors.

39. The method of making an artificial fingernail or toenail of claim 29 wherein the second grid pattern layer is comprised of transparent lenslets.

40. The method of making an artificial fingernail or toenail of claim 39 wherein lenslets are formed as a surface relief profile directly upon the primary substrate layer.

41. The method of making an artificial fingernail or toenail of claim 40 wherein the other grid pattern layer is comprised of a patterned array of mirrored concavities having its concave portions facing towards the concave portions of the lenslets.

* * * * *